US005871897A

United States Patent [19]

Katoh

[11] Patent Number: 5,871,897

[45] Date of Patent: Feb. 16, 1999

[54] SILVER HALIDE PHOTOGRAPHIC MATERIAL

[75] Inventor: Takashi Katoh, Kanagawa, Japan

[73] Assignee: Fuji Photo Film Co., Ltd., Minami Ashigara, Japan

[21] Appl. No.: 672,075

[22] Filed: Jun. 26, 1996

[30] Foreign Application Priority Data

Jun. 26, 1995 [JP] Japan ..... 7-159185

[51] Int. Cl.[6] ..... G03C 1/10

[52] U.S. Cl. ..... 430/581; 430/517; 430/587; 430/591; 430/593

[58] Field of Search ..... 430/581, 517, 430/591, 587, 593

[56] References Cited

U.S. PATENT DOCUMENTS

| | | | |
|---|---|---|---|
| 3,243,298 | 3/1966 | Libeer et al. | 430/581 |
| 4,950,587 | 8/1990 | Roberts et al. | 430/581 |
| 5,478,719 | 12/1995 | Hioki et al. | 430/572 |

OTHER PUBLICATIONS

S. Hünig and E. Wolff, Liebigs Ann. Chem. 732, 26–42 (1970) pp. 26–43.

A Macrocyclic Bis–Cyanine Dye, I.L. Mushkalo, et al, Tetrahedron Letters, vol. 21, pp. 2977–2980.

Ultraviolet and Visible Absorption Spectra of Biscarbocyanine Dyes, G.G. Dyadyusha, et al Dyes and Pigments, 10 (1989), pp. 111–121.

The Theory of TYhe Photographic Process, fourth edition T.H. James, 1997, pp. 194–297.

*Primary Examiner*—Thorl Chea

*Attorney, Agent, or Firm*—Birch, Stewart, Kolasch & Birch, LLP

[57] ABSTRACT

A silver halide photographic material is disclosed, which contains a connected-dye compound having a fixed configuration in which one cyanine dye plane is in parallel with and lies over the other so that the connected-dye compound always shows an absorption assignable to a cyanine dye aggregate thereof. The silver halide photographic material has excellent storage stability.

7 Claims, No Drawings

SILVER HALIDE PHOTOGRAPHIC MATERIAL

FIELD OF THE INVENTION

The present invention relates to a silver halide photographic material containing a novel connected-dye compound.

BACKGROUND OF THE INVENTION

Cyanine dyes are important compounds used as photographic sensitizing dyes, dyes, fluorescent coatings, functional materials (e.g., nonlinear optical materials), pigments, medicines, etc.

It is known that cyanine dyes form aggregates to give an aggregation absorption different from the absorptions assignable to the monomers. In particular, J aggregates are extensively utilized for the spectral sensitization of silver halide photographic materials. In general, however, controlling the aggregates of cyanine dyes is very difficult and the mode of aggregation changes are aggregates into various ones as a result of the influence of dye addition conditions, the compositions of silver halide emulsions, additives, or other factors.

Proposed as a means for enabling a dye aggregate to have only one mode of aggregation is a compound comprising two cyanine dyes connected to each other (hereinafter referred to as a connected-dye compound). Examples thereof include the dye described in *Tetrahedron Letter,* Vol. 21, pp. 2977–2980 (1980) and the dye described in *Dyes and Pigments,* Vol. 10, pp. 111–120 (1989).

However, these conventional connected-dye compounds have a problem that the configuration of the connected groups is still unfixed and the same aggregation state cannot always be maintained, or that the mode of connection is different from that of a dye aggregation model (i.e., the structure in which one dye plane is in parallel with and lies over the other).

It has consequently been desired to develop a connected-dye compound having the same configuration as a dye aggregate.

SUMMARY OF THE INVENTION

An object of the present invention is to provide a silver halide photographic material containing a connected-dye compound having the same configuration as a dye aggregate.

The above object of the present invention is accomplished with a silver halide photographic material which contains a connected-dye compound having a fixed configuration in which one cyanine dye plane is in parallel with and lies over the other so that the connected-dye compound always shows an absorption assignable to a cyanine dye aggregate. Examples of the connected-dye compound include compounds represented by formula (I):

$$A1—S—A2 \qquad (I)$$

wherein A1 and A2 each represents a cyanine dye and S represents a spacer comprising an aromatic compound residue.

Preferred of the compounds represented by formula (I) are compounds represented by formula (II):

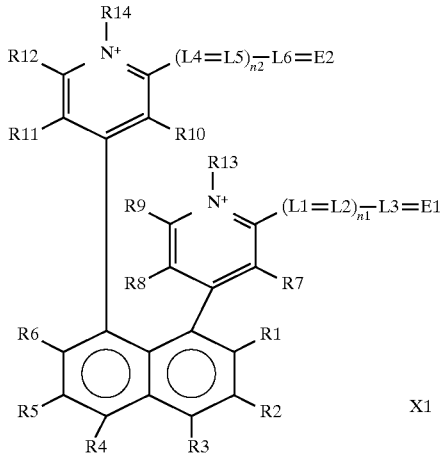

(II)

wherein R1, R2, R3, R4, R5, R6, R7, R8, R9, R10, R11, and R12 each represents a hydrogen atom or a substituent; R13 and R14 each represents an alkyl group; L1, L2, L3, L4, L5, and L6 each represents a methine chain; E1 and E2 each represents an auxochrome; n1 and n2 each is 0, 1, 2, or 3; and X1 represents a counter ion.

Especially preferred of the compounds represented by formula (I) are compounds represented by formula (III):

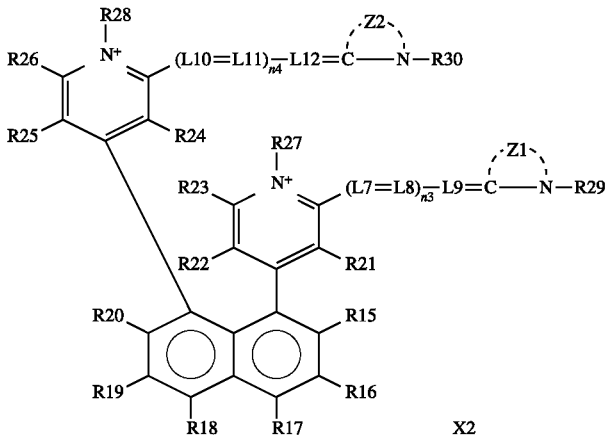

(III)

wherein R15, R16, R17, R18, R19, R20, R21, R22, R23, R24, R25, and R26 each represents a hydrogen atom or a substituent; R27 and R28 each represents an alkyl group; L7, L8, L9, L10, L11, and L12 each represents a methine chain; Z1 and Z2 each represents an atomic group necessary for forming a five- or six-membered nitrogen-containing heterocyclic ring; n3 and n4 each is 0, 1, 2, or 3; and X2 represents a counter ion.

DETAILED DESCRIPTION OF THE INVENTION

The compounds represented by formulae (I), (II), and (III) are explained below in detail.

A1 and A2 each represents a cyanine dye. The cyanine dye represents a chromophore shown by any of the formulae (A), (B), and (C) given in T. H. James, ed., *The Theory of the Photographic Process,* 4th ed., p. 195 (1977). Specific examples thereof include the cyanine compounds given in F. M. Sturmer, *Heterocyclic Compounds—Cyanine Dyes and Related Compounds—,* (John Wiley & Sons, New York, London, 1964).

S represents a spacer comprising an aromatic compound residue. Examples thereof include residues of benzene naphthalene, anthracene, biphenylene, anthraquinone, pyridine, quinoline, isoquinoline, and the like. Preferred of these are residues of naphthalene and anthracene. A residue of such an aromatic compound means a group formed by removing two adjacent hydrogen atoms from the compound. A 1,8-naphthalene residue is a representative example thereof.

R1, R2, R3, R4, R5, R6, R7, R8, R9, R10, R11, R12, R15, R16, R17, R18, R19, R20, R21, R22, R23, R24, R25, and R26 each represents a hydrogen atom or a substituent.

Examples of the substituent represented by R1–R12 and R15–R26 include halogen atoms (e.g., chlorine, bromine, iodine, and fluorine), alkyl groups having 1 to 20 carbon atoms [e.g., methyl, ethyl, n-propyl, n-butyl, isobutyl, and isopropyl; the alkyl groups may be substituted with substituents such as, e.g., a halogen atom, a nitro group, an alkoxy group (e.g., methoxy or ethoxy), an aryloxy group (e.g., phenoxy), an amide group, an alkynyl group, an alkenyl group, a carbamoyl group, a sulfo group, a hydroxy group, and a carboxy group, these substituents being hereinafter referred to as "substituents X"], aryl groups having 1 to 20 carbon atoms (e.g., phenyl, 1-naphthyl, and 2-naphthyl; the aryl groups may be substituted with substituents, examples of which include substituents X), alkoxy groups having 1 to 20 carbon atoms (e.g., methoxy, ethoxy, and n-propoxy; the alkoxy groups may be substituted with substituents, examples of which include substituents X), aryloxy groups having 1 to 20 carbon atoms (e.g., phenoxy, 1-naphthoxy, and 2-naphthoxy; the aryloxy groups may be substituted with substituents, examples of which include substituents X), a cyano group, acyl groups having 1 to 20 carbon atoms (e.g., acetyl and benzoyl; the acyl groups may be substituted with substituents, examples of which include substituents X), alkylsulfamoyl groups having 1 to 20 carbon atoms (e.g., methylsulfamoyl; the alkylsulfamoyl groups may be substituted with substituents, examples of which include substituents X), a carboxy group, alkylcarbonyl groups having 1 to 20 carbon atoms (e.g., methylcarbonyl and ethylcarbonyl; the alkylcarbonyl groups may be substituted with substituents, examples of which include substituents X), a hydroxy group, alkylthio groups having 1 to 20 carbon atoms (e.g., methylthio and ethylthio; the alkylthio groups may be substituted with substituents, examples of which include substituents X), alkenyl groups having 1 to 20 carbon atoms (e.g., ethenyl and 1-propenyl; the alkenyl groups may be substituted with substituents, examples of which include substituents X), and alkynyl groups having 1 to 20 carbon atoms (e.g., ethynyl and 1-propynyl; the alkynyl groups may be substituted with substituents, examples of which include substituents X).

It is preferred that R1, R2, R3, R4, R5, R6, R7, R8, R9, R10, R11, R12, R15, R16, R17, R18, R19, R20, R21, R22, R23, R24, R25, and R26 each be a hydrogen atom, a halogen atom, an alkyl group, or an aryl group, in particular a hydrogen atom, a chlorine atom, or methyl.

R13, R14, R27, and R28 each preferably represents an alkyl group having 1 to 20 carbon atoms. (Examples of the alkyl group include methyl, ethyl, n-propyl, n-butyl, n-pentyl, n-hexyl, isopropyl, isobutyl, and isopentyl; such alkyl groups may be substituted with substituents, examples of which include substituents X. Preferred substituents include a sulfo group, a carboxy group, alkoxy groups, alkenyl groups, and an amide group. In the case of a sulfo substituent, examples of the counter ion therefor include alkali metals and quaternary ammonium compounds, such as, e.g., sodium, potassium, pyridinium, and triethylammonium.)

It is preferred that R13, R14, R27, and R28 each be methyl, ethyl, propyl, sulfoethyl, sulfopropyl, or sulfobutyl.

L1, L2, L3, L4, L5, L6, L7, L8, L9, L10, L11, and L12 each represents a methine group {which may be substituted [examples of substituents include alkyl groups (e.g., methyl, ethyl, and 2-carboxyethyl), alkoxy groups (e.g., methoxy and ethoxy), amino groups (e.g., N,N-dimethylamino, N,N-diphenylamino, and N-methylpiperazino), halogen atoms (e.g., chlorine, bromine, and iodine), and aryl groups (e.g., phenyl)]}. L1 to L12 may form a ring, or may form a ring in cooperation with an auxochrome.

Preferred of those substituents for the methine group are alkyl groups, aryl groups, and halogen atoms. When n1=1, L2 is preferably substituted. When n1=2, L2 or L3 is preferably substituted.

It is preferred that L1, L2, L3, L4, L5, L6, L7, L8, L9, L10, L11, and L12 each be an unsubstituted methine group.

E1 and E2 each represents an auxochrome. The auxochrome is as defined in Sumio Tokida, *Color Chemistry,* pp. 111–113 (1982), Maruzen K.K. This auxochrome is the same as the terminal group described in T. H. James, ed., *The Theory of the Photographic Process,* 4th ed., pp. 197–200 (1977). Examples of the auxochrome include the functional groups given in Color Chemistry, pp. 112–113, and the basic heterocycles and the acid heterocycles respectively given under "A" and "B" in *The Theory of the Photographic Process,* 4th ed., p. 199, Table 8.2.

Preferred examples of E1 and E2 include 2-pyridyl, 4-pyridyl, 2-quinolyl, 4-quinolyl, 2-thiazolyl, 2-benzothiazolyl, 2-imidazolyl, 2-benzimidazolyl, 2-oxazolyl, 2-benzoxazolyl, 2-quinoxalinyl, 2-indolenyl, 2-rhodanyl, 2-thiohydantoinyl, 2-hydantoinyl, 2-indanyl, 4-dimethylaminophenyl, and 4-hydroxyphenyl.

Each of n1, n2, n3, and n4 is 0, 1, 2, or 3, preferably 0, 1, or 2.

X1 and X2 each represents a counter ion. Whether a dye is a cation or an anion or has a net ionic charge depends on its auxochrome(s) and substituent(s).

Representative cations are an ammonium ion and alkali metal ions. On the other hand, the anion may be either an inorganic anion or an organic anion. A combination of two or more kinds of ions is possible.

Examples of cations include a sodium ion, potassium ion, triethylammonium ion, and pyridinium ion. Examples of anions include halogen anions (e.g., a chlorine ion, bromine ion, and iodine ion), substituted arylsulfonate ions (e.g., a p-toluenesulfonate ion and p-chlorobenzenesulfonate ion), alkylsulfate ions (e.g., a methylsulfate ion), a sulfate ion, a perchlorate ion, a tetrafluoroborate ion, a picrate ion, an acetate ion, a trifluoromethanesulfonate ion, and an n-butyltriphenylborate ion.

Z1 and Z2 each represents an atomic group necessary for forming a five- or six-membered nitrogen-containing heterocyclic ring. Examples thereof include thiazole nuclei (e.g., thiazole, 4-methylthiazole, and 4-phenylthiazole), benzothiazole nuclei (e.g., benzothiazole, 5-chlorobenzothiazole, 4-methylbenzothiazole, 5-methoxybenzothiazole, 6-ethoxybenzothiazole, 5-bromobenzothiazole, 5-iodobenzothiazole, 5-phenylbenzothiazole, and 5,6-dimethylbenzothiazole), naphthothiazole nuclei (e.g., naphtho[2,1-d]thiazole and naphtho[1,2-d]thiazole), oxazole nuclei (e.g., oxazole and 4-methyloxazole), benzoxazole nuclei (e.g., benzoxazole, 5-chlorobenzoxazole, 5-phenylbenzoxazole, and 5-bromobenzoxazole), naphthoxazole nuclei (e.g., naphtho[2,1-d]oxazole and naphtho[1,2-d]oxazole), benzimidazole nuclei (e.g., benzimidazole, 1-methylbenzimidazole, and 1-methyl-5,6-dichlorobenzimidazole), pyridine nuclei (e.g., pyridine, 2-methylpyridine, 4-methylpyridine, 2-chloropyridine, 3-bromopyridine, and 4-phenylpyridine), quinoline nuclei (e.g., 2-quinoline, 4-quinoline, 3-methyl-2-quinoline, 5-ethyl-2-quinoline, 6-chloro-2-quinoline, and 8-methyl-2-quinoline), isoquinoline nuclei, and pyrimidine nuclei.

The nucleus formed by Z1 and that formed by Z2 each is preferably a pyridine, quinoline, benzothiazole, benzoxazole, or benzimidazole nucleus.

The following are preferred combinations of substituents.

In one preferred substituent combination, R1 to R12 each is a hydrogen atom, R13 and R14 each is an alkyl group, L1 to L6 each is an unsubstituted methine group or an alkyl-substituted methine group, and E1 and E2 each is 2-benzothiazolyl, 2-pyridinyl, 2-quinolyl, 2-benzoxazolyl, or 2-benzimidazolyl. In another preferred substituent combination, R1 to R8, R10, and R11 each is a hydrogen atom, R9 and R12 each is an alkyl group, L1 to L6 each is an unsubstituted methine group or an alkyl-substituted methine group, and E1 and E2 each is 2-benzothiazolyl, 2-pyridinyl, 2-quinolyl, 2-benzoxazolyl, or 2-benzimidazolyl.

Specific examples of the compounds represented by formulae (I), (II), and (III) for use in the present invention are shown below, but these examples should not be construed as limiting the scope of the invention.

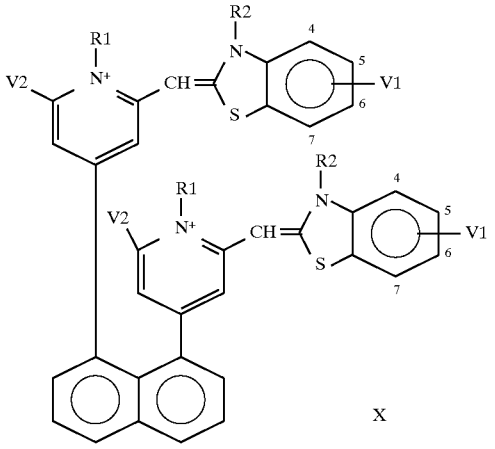

| Compound No. | R1 | R2 | V1 | V2 | X |
|---|---|---|---|---|---|
| 1 | $CH_3$ | $CH_3$ | H | H | $2ClO_4^-$ |
| 2 | " | " | " | $CH_3$ | " |
| 3 | " | " | 5-Cl | H | " |
| 4 | " | " | 5-$OCH_3$ | " | " |
| 5 | " | " | " | $CH_3$ | " |
| 6 | " | " | 5-Cl | " | " |
| 7 | " | " | 6-$CH_3$ | H | $2I^-$ |
| 8 | " | " | 4-$OCH_3$ | " | $2Br^-$ |
| 9 | $C_2H_5$ | $C_2H_5$ | 7-Cl | " | " |
| 10 | $(CH_2)_3SO_3^-$ | " | H | " | — |
| 11 | " | $(CH_2)_3SO_3^-$ | 5-Cl | " | $2Na^+$ |
| 12 | $(CH_2)_4SO_3^-$ | $(CH_2)_4SO_3^-$ | H | " | $2\overset{+}{H}N(C_2H_5)_3$ |
| 13 | $(CH_2)_2OCH_3$ | $(CH_2)_2OCH_3$ | " | $CH_3$ | $2I^-$ |

-continued

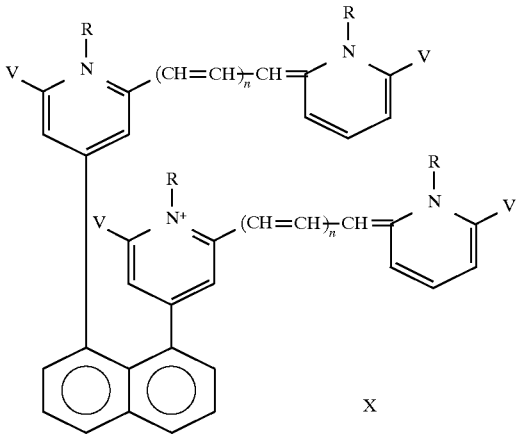

X

| Compound No. | n | R | V | X |
|---|---|---|---|---|
| 14 | 0 | $CH_3$ | H | $2ClO_4^-$ |
| 15 | 0 | $C_2H_5$ | " | $2I^-$ |
| 16 | 0 | $CH_3$ | $CH_3$ | $2ClO_4^-$ |
| 17 | 1 | " | H | " |
| 18 | 1 | " | $CH_3$ | " |
| 19 | 1 | $(CH_2)_3SO_3^-$ | H | $2Na^+$ |
| 20 | 2 | $CH_3$ | " | $2ClO_4^-$ |
| 21 | 2 | " | $CH_3$ | " |
| 22 | 3 | " | H | " |
| 23 | 3 | " | $CH_3$ | " |

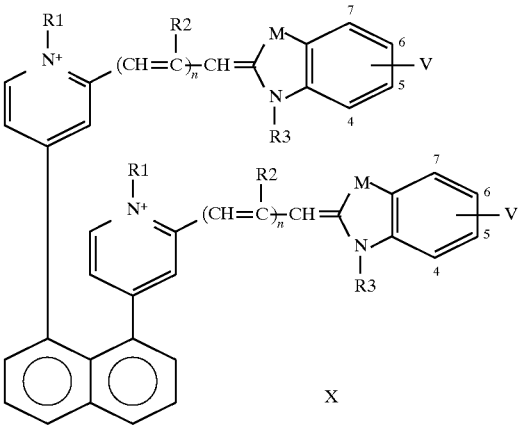

X

| Compound No. | M | n | R1 | R2 | R3 | V | X |
|---|---|---|---|---|---|---|---|
| 24 | S | 1 | $CH_3$ | H | $CH_3$ | H | $2ClO_4^-$ |
| 25 | " | " | " | $C_2H_5$ | " | " | " |
| 26 | " | " | " | " | " | 5-Cl | " |
| 27 | " | " | $(CH_2)_3SO_3^-$ | H | $(CH_2)_3SO_3^-$ | H | $2Na^+$ |
| 28 | " | 2 | $CH_3$ | " | $CH_3$ | " | $2ClO_4^-$ |
| 29 | " | 3 | " | " | " | " | " |
| 30 | O | 0 | " | — | " | " | " |
| 31 | " | " | " | — | " | 5-$OCH_3$ | " |
| 32 | " | " | " | — | " | 5-Cl | " |
| 33 | " | 1 | " | H | " | H | " |
| 34 | " | " | " | $C_2H_5$ | " | 5-$C_6H_5$ | $2I^-$ |
| 35 | " | 2 | " | H | " | " | $2ClO_4^-$ |
| 36 | $N-C_2H_5$ | 0 | $CH_3$ | — | $C_2H_5$ | " | " |
| 37 | " | 1 | " | H | " | " | " |
| 38 | " | 2 | " | " | " | " | " |
| 39 | $-CH=CH-$ | 0 | " | — | $CH_3$ | " | " |
| 40 | " | 1 | " | H | " | " | " |

-continued
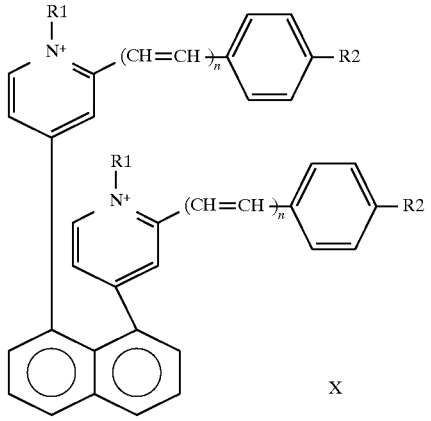
X
| Compound No. | n | R1 | R2 | X |
|---|---|---|---|---|
| 41 | 1 | $CH_3$ | $O^-$ | — |
| 42 | " | " | $N(CH_3)_2$ | $2ClO_4^-$ |
| 43 | 2 | " | $O^-$ | — |
| 44 | " | " | $N(CH_3)_2$ | $2ClO_4^-$ |
| 45 | 1 | " | CN | " |
| 46 | " | " | $NO_2$ | " |
No. 47
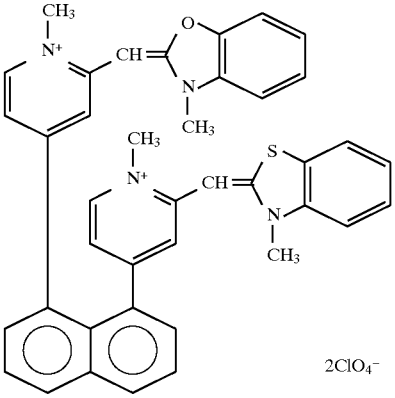
$2ClO_4^-$
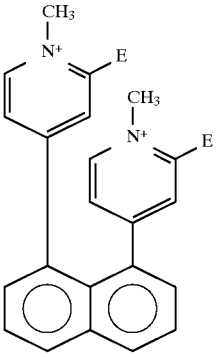
| Compound No. | E |
|---|---|
| 48 | 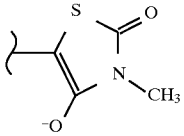 |

-continued
| | |
|---|---|
| 49 | 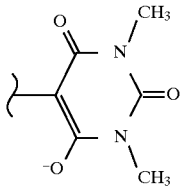 |
| 50 | 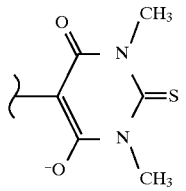 |
| 51 | 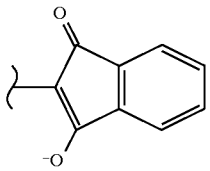 |
| 52 | 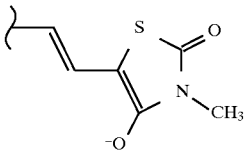 |
~ indicates a bonding site
No. 53
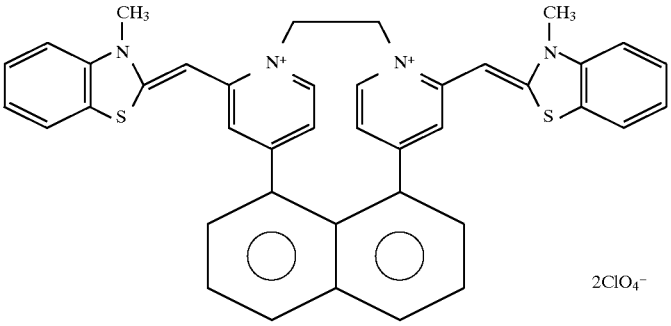

-continued
No. 54
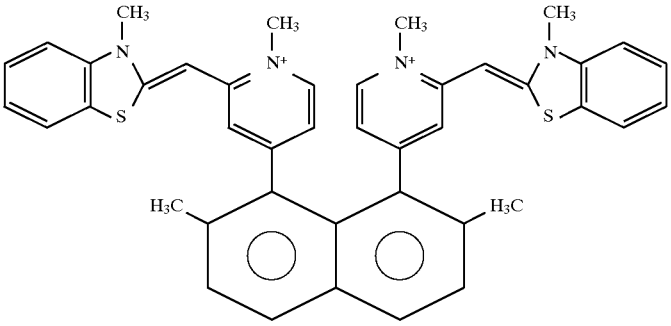
No. 55
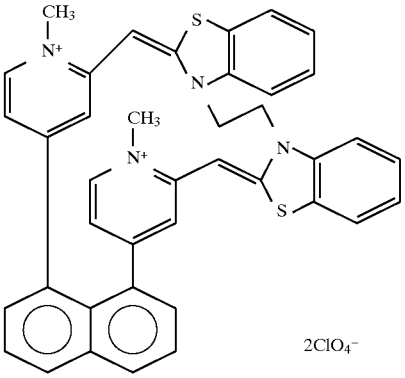
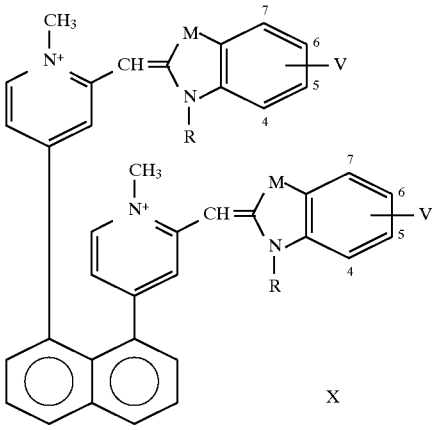
| Compound No. | M | R | V | X |
|---|---|---|---|---|
| 56 | S | $CH_3$ | 6-t-butyl | $2ClO_4^-$ |
| 57 | " | " | 5-$Si(CH_3)_3$ | " |
| 58 | " | " | 5-Mes | " |
| 59 | " | " | 5-Trip | " |
| 60 | " | " | 5-Ar | " |
| 61 | " | $C_2H_5$ | " | " |
Mes = 2,4,6-trimethyl phenyl
Trip = 2,4,6-triphenyl phenyl
Ar = 2,4,6-tri-t-butyl phenyl
Synthesis Examples for compounds represented by formulae (I), (II), and (III) are given below.

SYNTHESIS EXAMPLE 1

(Synthesis of Compound No. 1)

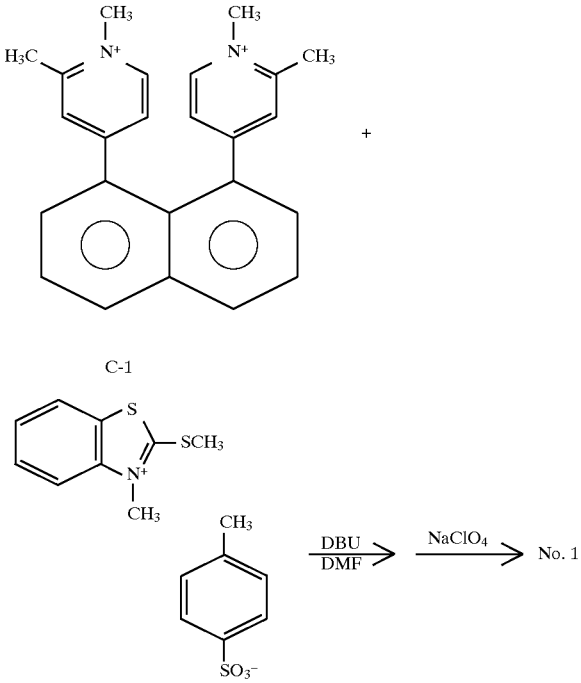

Compound (C-1) used as a starting material was synthesized by a method described in Japanese Patent Application No. 7-30209. A DMF solution of 50 mg of compound (C-1), 90 mg of compound (C-2), and 38 mg of diazabicycloundecene (DBU) was heated with stirring for 2 hours in an oil bath having an external temperature of 50° C. An aqueous methanol solution of tetrabutylammonium perchlorate was then added to the solution to obtain crude crystals. The crude crystals obtained were repeatedly recrystallized from a methanol/methylene chloride solution to obtain Compound No. 1.

Yielded amount, 45 mg (yield, 64%)

λmax=440 nm (∈=5.29×10$^4$) (MeOH)

Melting point, ≧300° C.

$^1$H-NMR (DMSO-d$^6$) δ3.63(s,6H), 4.02(s,6H), 5.59(s, 2H), 6.90(t,2H,J=7.6 Hz), 6.99(dd,2H,J=2 Hz,J=6.7 Hz), 7.1–7.25(m,4H), 7.35–7.41(m,4H), 7.75–7.90(m, 4H), 8.21(d,2H,J=6.7 Hz), 8.39(d,2H,J=8.0 Hz) ppm IR (KBr) 1638, 1530, 1480, 1380, 1322, 1276, 1221, 1182, 1091, 1020, 880, 820, 744, 621 cm$^{-1}$ FAB-MS M-$ClO_4^-$=733

The compounds represented by formulae (I), (II) and (III) can be synthesized by methods described in the following monographs or by methods cited therein.

(a) D. M. Hamer, *Heterocyclic Compounds—Special Topics in Heterocyclic Chemistry—*, chap. 8 (John Wiley & Sons, New York, London, 1977).

(b) F. M. Sturmer, *Heterocyclic Compounds—Cyanine Dyes and Related Compounds—*, (John Wiley & Sons, New York, London, 1964).

The methine compound which is the biscyanine dye for use in the silver halide photographic material of the present invention can be used in combination with other sensitizing dyes.

In preparing a silver halide emulsion for use in the present invention, the methine compound (and other sensitizing dyes) for use in this invention may be added to the emulsion at any stage which has been regarded as useful. For example, the methine compound and sensitizing dyes may be added during the step of silver halide grain formation and/or before desalting, or added during the step of desalting and/or during the period of from the completion of desalting to the initiation of chemical ripening, as disclosed in, e.g., U.S. Pat. Nos. 2,735,766, 3,628,960, 4,183,756, and 4,225,666, JP-A-58-184142, and JP-A-60-196749. (The term "JP-A" as used herein means an "unexamined published Japanese patent application.") Alternatively, the methine compound and sensitizing dyes may be added just before or during chemical ripening or at any stage after chemical ripening to before emulsion application, as disclosed in, e.g., JP-A-58-113920. Further, a single compound alone or a combination thereof with a different kind of compound may be added portion-wise, for example, during the step of grain formation and during or after the step of chemical ripening, or before or during chemical ripening and after the completion thereof, as disclosed in, e.g., U.S. Pat. No. 4,225,666 and JP-A-58-7629. The kind and combination of the compounds thus added portion-wise may be changed.

Although the addition amount of the methine compound for use in the present invention varies depending on the shape and size of the silver halide grains, the methine compound may be used in an amount of from 4×10$^{-6}$ to 8×10$^{-3}$ mol per mol of the silver halide. For example, in the case where the size of the silver halide grains is from 0.2 to 1.3 μm, the addition amount of the methine compound is desirably from 2×10$^{-6}$ to 3.5×10$^{-3}$ mol, preferably from 7.5×10$^{-6}$ to 1.5×10$^{-3}$ mol, per mol of the silver halide.

The methine compound for use in the present invention can be directly dispersed into an emulsion. It is also possible to dissolve the methine compound into an appropriate solvent, e.g., methyl alcohol, ethyl alcohol, methyl Cellosolve, acetone, water, pyridine, or a mixture of two or more thereof, and add the solution into an emulsion. For this dissolution, additives such as, e.g., a base or acid and a surfactant may be added to the solvent, and ultrasonic may be used. Examples of methods for adding the methine compound include: a method comprising dissolving the compound into a volatile organic solvent, dispersing the solution into a hydrophilic colloid, and adding the dispersion to an emulsion, as described in, e.g., U.S. Pat. No. 3,469,987; a method comprising dispersing the methine compound into a water-miscible solvent and adding the dispersion to an emulsion, as described in, e.g., JP-B-46-24185 (the term "JP-B" as used herein means an "examined Japanese patent publication"); a method comprising dissolving the methine compound into a surfactant and adding the solution to an emulsion, as described in U.S. Pat. No. 3,822,135; a method comprising dissolving the methine compound using a compound which causes red shifting and adding the solution to an emulsion, as described in JP-A-51-74624; and a method comprising dissolving the methine compound into a substantially water-free acid and adding the solution to an emulsion, as described in JP-A-50-80826. Other usable methods for addition to an emulsion are described in, e.g., U.S. Pat. Nos. 2,912,343, 3,342,605, 2,996,287, and 3,429,835.

The methine compound of the present invention can be used as various filter dyes, anti-irradiation dyes, antihalation dyes, etc., for the purposes of enhancing sharpness, improving color separation ability, etc.

This methine compound may be incorporated into one or more coating fluids for forming, e.g., a silver halide photographic material layer, a filter layer, and an antihalation layer. The dye may be used in an amount sufficient to color the photographic layer; this amount can be easily selected by persons skilled in the art according to intended purposes. In general, the dye is preferably used in such an amount as to result in an optical density of from 0.05 to 3.0.

The methine compound may be added at any stage prior to coating.

A polymer having the charge opposite to that of the dye ion may be incorporated as a mordant into a layer together with the dye to thereby enable the dye to be present selectively in that layer due to interaction between the polymer and the dye molecules.

Examples of the polymer mordant include those described in U.S. Pat. Nos. 2,548,564, 4,124,386, 3,625,694, 3,958, 995, 4,168,976, and 3,445,231.

Examples of supersensitizers useful in spectral sensitization in the present invention include the pyrimidylamino compounds, triazinylamino compounds, and azolium compounds described in, e.g., U.S. Pat. Nos. 3,511,664, 3,615, 613, 3,615,632, 3,615,641, 4,596,767, 4,945,038 and 4,965, 182. Preferred methods for using such supersensitizers are described in these references.

Any silver halide selected from silver bromide, a silver iodobromide, a silver iodochlorobromide, a silver chlorobromide, and silver chloride may be used in the silver halide photographic material of the present invention. Preferred silver halides are silver bromide, a silver chlorobromide, a silver iodochlorobromide, and the high-chlorine silver chloride (silver halide having a high silver chloride) as described in JP-A-2-42.

Constitutions, processings, and others of the photographic material are described below. The constitution and processing described in JP-A-2-42 are preferably employed especially in the case of using a high-chlorine silver chloride.

The constitution and processing described in JP-A-63-264743 are preferably employed especially in the case of using a silver chlorobromide.

The silver halide grains contained in the photographic material may have a regular crystal form such as, e.g., cube, tetradecahedron, or a rhombic dodecahedron, or may have an irregular crystal form such as, e.g., a spherical or platy form, or may have a composite crystal form comprising two or more such crystal forms. The silver halide grains may be a mixture of grains in various crystal forms.

The individual silver halide grains may have a core phase and a surface phase different from the core phase, or may consist of a homogeneous phase. The silver halide grains may be grains in which a latent image is formed mainly on the grain surface (e.g., a negative photosensitive material), or may be grains in which a latent image is formed mainly inside the grains (e.g., an internal latent image type photosensitive material) or grains which have been fogged beforehand (e.g., a direct positive photosensitive material).

Silver halide grains having the above-described various halogen compositions, crystal habits, internal grain structures, shapes, and distributions are used in photosensitive materials (elements) for use in various applications.

The methine compound of the present invention is used in photographic materials for the following applications as a sensitizer, a sensitizing dye, or a filter or for the purpose of antihalation, anti-irradiation, etc. Besides being incorporated in a photosensitive emulsion layer, the dye may be added to a desired layer such as, e.g., an interlayer, a protective layer, or a back layer.

The methine compound of the present invention is used in various color and black-and-white silver halide photographic materials.

Examples of such photographic materials include a photographic material for color positive, a photographic material for color paper, a photographic material for color negative, a photographic material for color reversal (which may or may not contain a coupler), a silver halide photographic material for direct positive, a photographic material for platemaking (e.g., a lith film or a lith dupe film), a photographic material for cathode ray tube display, a photographic material for X-ray recording (in particular a material for direct or indirect photography using a screen), a photographic material for use in the silver salt diffusion transfer process, a photographic material for use in the color diffusion transfer process, a photographic material for use in the dye transfer process (imbibition process), a photographic material for use in the silver dye bleach process, and a photographic material for heat development.

The silver halide photographic emulsion for use in the present invention can be prepared by methods described in, e.g., P. Glafkides, "Chimie et Physique Photographique" (published by Paul Montel, 1967); G. F. Duffin, "Photographic Emulsion Chemistry," (published by The Focal Press, 1966); and V. L. Zelikman et al., "Making and Coating Photographic Emulsion," (published by The Focal Press, 1964).

A silver halide solvent may be used in the formation of silver halide grains for the purpose of controlling grain growth. Examples of the silver halide solvent include ammonia, potassium thiocyanate, ammonium thiocyanate, thioether compounds (e.g., those given in U.S. Pat. Nos. 3,271,157, 3,574,628, 3,704,130, 4,297,439, and 4,276, 374), thione compounds (e.g., those given in JP-A-53-144319, JP-A-53-82408, and JP-A-55-77737), and amine compounds (e.g., those given in JP-A-54-100717).

The formation of silver halide grains or the step of physical ripening may be conducted in the presence of a cadmium, zinc, thallium, or iridium salt or a complex salt thereof, a rhodium salt or a complex salt thereof, an iron salt or an iron complex salt, etc.

Examples of internal latent image type silver halide emulsions that can be used in the present invention include the conversion type silver halide emulsions described in, e.g., U.S. Pat. Nos. 2,592,250, 3,206,313, 3,447,927, 3,761, 276, and 3,935,014, core/shell type silver halide emulsions, and silver halide emulsions containing a different kind of metal.

The silver halide emulsion is usually chemically sensitized. For chemical sensitization, use may be made, for example, of the methods described in H. Frieser, ed., "Die Grundlagen der Photographischen Prozesse mit Silberhalogeniden," Akademische Verlagsgesellschaft (1968), pp. 675–734.

Namely, the following and other methods may be used alone or in combination: the sulfur sensitization method in which an active gelatin or a sulfur compound reactive with silver (e.g., a thiosulfate, thiourea or a derivative thereof, a mercapto compound, or rhodanine or a derivative thereof) is used; the selenium sensitization method; the reduction sensitization method in which a reducing substance (e.g., a stannous salt, an amine, a hydrazine derivative, a formamidinesulfinic acid, or a silane compound) is used; and the noble metal sensitization method in which a noble metal compound (e.g., a gold complex salt or a complex salt of a Group VIII metal of the periodic table, e.g., Pt, Ir, or Pd) is used.

For the purpose of preventing fogging during the production, storage, or processing of the photographic material of the present invention or of stabilizing the photographic performance thereof, various compounds may be incorporated into the photographic material. Examples thereof include many compounds known as antifoggants or stabilizers, such as thiazole compounds, e.g., the benzothiazolium salts given in, e.g., U.S. Pat. Nos. 3,954,478 and 4,942,721 and JP-A-59-191032 and the compounds formed therefrom through ring-opening as given in JP-B-59-26731, nitroindazole compounds, triazole compounds, benztriazole compounds, and benzimidazole compounds (in particular nitro- or halogen-substituted compounds); heterocyclic mercapto compounds, e.g., mercaptothiazoles, mercaptobenzthiazoles, mercaptobenzimidazoles, mercaptothiadiazoles, mercaptotetrazoles (in particular 1-phenyl-5-mercaptotetrazole), and mercaptopyrimidines; heterocyclic mercapto compounds of the above kind which have a water-soluble group, e.g., a carboxyl or sulfo group; thioketone compounds, e.g., oxazolinethione; azaindenes, e.g., tetrazaindenes (in particular 4-hydroxy(1,3,3*a*,7) tetrazaindenes); benzenethiosulfonic acids; benzenesulfinic acids; and the acetylene compounds given in JP-A-62-87957.

The silver halide photographic material of the present invention may contain color couplers, e.g., a cyan coupler, a magenta coupler, and a yellow coupler, and a compound for dispersing such couplers.

Namely, the photographic material may contain a compound which, in color development, is capable of forming a color upon oxidative coupling with an aromatic primary amine developing agent (e.g., a phenylenediamine derivative or an aminophenol derivative). Examples of magenta couplers include 5-pyrazolone coupler, pyrazolobenzimidazole coupler, cyanoacetylcoumarone coupler, and noncyclic acylacetonitrile couplers. Examples of yellow couplers include acylacetamide couplers (e.g., benzoylacetanilides and pyvaloylacetanilides). Examples of cyan couplers include naphthol coupler and phenol coupler. These couplers are desirably nondiffusion couplers having a hydrophobic group called a ballast in the molecule. The couplers each may be either four equivalents or two equivalents to a silver ion. The couplers may be colored couplers having a color-compensating effect, or may be couplers which release a development inhibitor in development (so-called DIR couplers).

Besides a DIR coupler, a non-dye-forming DIR coupling compound may be contained which, upon coupling reaction, yields a colorless reaction product and releases a development inhibitor.

For the purpose of enhancing sensitivity or contrast or accelerating development, compounds such as, e.g., poly (alkylene oxide)s or ethers, esters, amines, and other derivatives thereof, thioether compounds, thiomorpholines, quaternary ammonium salt compounds, urethane derivatives, urea derivatives, imidazole derivatives, and 3-pyrazolidones may be incorporated into the photographic material of the present invention.

Various dyes may be incorporated as filter dyes or for anti-irradiation or other various purposes into the silver halide photographic material of the present invention, in addition to the methine compound of the invention.

Examples of such dyes include the oxonol dyes having a pyrazolone nucleus or a barbituric acid nucleus, as given in British Patents 506,385, 1,177,429, 1,311,884, 1,338,799, 1,385,371, 1,467,214, 1,433,102, and 1,553,516, JP-A-48-85130, JP-A-49-114420, JP-A-52-117123, JP-A-55-161233, JP-A-59-111640, JP-B-39-22069, JP-B-43-13168, JP-B-62-273527, and U.S. Pat. Nos. 3,247,127, 3,469,985, and 4,078,933; the oxonol dyes of other kinds given in U.S. Pat. Nos. 2,533,472 and 3,379,533, British Patent 1,278,621, JP-A-1-134447, and JP-A-1-183652; the azo dyes given in British Patents 575,691, 680,631, 599,623, 786,907, 907, 125, and 1,045,609, U.S. Pat. No. 4,255,326, and JP-A-59-211043; the azomethine dyes given in JP-A-50-100116, JP-A-54-118247, and British Patents 2,014,598 and 75031; the anthraquinone dyes given in U.S. Pat. No. 2,865,752; the arylidene dyes given in U.S. Pat. Nos. 2,533,009, 2,688,541, and 2,538,008, British Patents 584,609 and 1,210,252, JP-A-50-40625, JP-A-51-3623, JP-A-51-10927, JP-A-54-118247, JP-B-48-3286, and JP-B-59-37303; the styryl dyes given in JP-B-28-3082, JP-B-44-16594, and JP-B-59-28898; the triarylmethane dyes given in British Patents 446,583 and 1,335,422 and JP-A-59-228250; the merocyanine dyes given in British Patents 1,075,653, 1,153,341, 1,284,730, 1,475,228, and 1,542,807; and the cyanine dyes given in U.S. Pat. Nos. 2,843,486 and 3,294,539 and JP-A-1-291247.

In order to prevent diffusion of such dyes, the following methods may be used.

For example, there is a method in which an anionic dye is incorporated into a specific layer together with a hydrophilic polymer, as a mordant, having the charge opposite to the charge of the dissociated anionic dye to thereby enable the dye to be present selectively in that layer due to interaction between the polymer and the dye molecules. This method is disclosed in, e.g., U.S. Pat. Nos. 2,548,564, 4,124,386, and 3,625,694.

Further, a method of using a water-insoluble solid dye to dye a specific layer is disclosed in, e.g., JP-A-56-12639, JP-A-55-155350, JP-A-55-155351, JP-A-63-27838, JP-A-63-197943, and European Patent 15,601.

Furthermore, a method in which fine metal salt particles having a dye adsorbed thereonto are used to dye a specific layer is disclosed in, e.g., U.S. Pat. Nos. 2,719,088, 2,496,841, and 2,496,843 and JP-A-60-45237.

Various surfactants may be incorporated into the photographic material of the present invention for various purposes, for example, as a coating aid or for the prevention of static build-up, improvement of slip properties, emulsification and dispersion, antiadhesion, and improvement of photographic properties (e.g., development acceleration, contrast enhancement, and sensitization).

In practicing the present invention, other additives are used together with the silver halide emulsion or another hydrophilic colloid. Examples of such additives include fading inhibitors, inorganic or organic hardeners, color fogging inhibitors, ultraviolet absorbers, mordants, plasticizers, latex polymers, and matting agents. Specific examples of these additives are given in, e.g., *Research Disclosure,* Vol. 176 (1978, XI), D-17643.

A hydrophilic polymer, e.g., gelatin, is used as a protective colloid in the photographic material for use in the present invention.

The finished silver halide emulsion, etc. are applied to an appropriate support, e.g., baryta paper, a resin-coated paper, a synthetic paper, a triacetate film, a poly(ethylene terephthalate) film, another plastic base, or a glass plate.

Exposure for obtaining a photographic image may be conducted by an ordinary method. Any of various known light sources may be used, such as, e.g., natural light (sunlight), a tungsten lamp, a fluorescent lamp, a mercury lamp, a xenon arc lamp, a carbon arc lamp, a xenon flash lamp, and a cathode ray tube flying spot. Exposure times of from $1/1{,}000$ to 1 second, which are used for ordinary cameras, are of course usable. It is also possible to use shorter exposure times of, for example, from $1/10^4$ to $1/10^6$second, which are obtained with, e.g., a xenon flash lamp or a cathode ray tube, and to use exposure times longer than 1 second. If desired and necessary, a color filter may be used to control the spectral energy distribution of the light used for exposure. Laser light may also be used for exposure. Furthermore, the photographic material may be exposed to the light emitted from a phosphor excited with electron rays, X-rays, γ rays, α rays, etc.

For the photographic processing of the photographic material of the present invention, any of known methods and known processing solutions such as those described in *Research Disclosure,* Vol. 176, pp. 28–30 (RD-17643) can be used. This photographic processing may be either of photographic processing for forming a silver image (black-and-white photographic processing) and photographic processing for forming a color image (color photographic processing) according to purposes. Although a processing temperature between 18° C. and 50° C. is usually selected, a processing temperature lower than 18° C. or higher than 50° C. may be used.

The silver halide photographic material of the present invention may have a magnetic recording layer. This photographic material having a magnetic layer (hereinafter also referred to as "sensitive material") may be obtained by a process comprising: heat-treating (annealing) the preheat-treated thin polyester support described in JP-A-6-35118, JP-A-6-17528, and *Journal of Technical Disclosure,* 94-6023, Japan Institute of Invention and Innovation, e.g., a polyethylene aromatic dicarboxylate type polyester support with a thickness of 50 to 300 μm, desirably 50 to 200 μm, preferably 80 to 115 μm, especially preferably 85 to 105 μm, at a temperature of 40° C. or higher but not higher than the glass transition temperature of the support for 1 to 1,500 hours; subjecting the annealed support to a surface treatment, e.g., the ultraviolet irradiation described in JP-B-43-2603, JP-B-43-2604, and JP-B-45-3828, the corona discharge described in, e.g., JP-B-48-5043 and JP-A-51-131576, or the grow discharge described in JP-B-35-7578 and JP-B-46-43480; priming the surface-treated support in the manner described in U.S. Pat. No. 5,326,689; optionally forming the substratum described in U.S. Pat. No. 2,761,791; and applying a coating composition containing the ferromagnetic particles described in JP-A-59-23505, JP-A-4-195726, and JP-A-6-59357.

The magnetic layer thus formed may be in the stripe form described in JP-A-4-124642 and JP-A-4-124645.

The support having the thus-formed magnetic layer is subjected if desired to the antistatic treatment described in JP-A-4-62543, before a silver halide emulsion is finally applied thereto. The silver halide emulsion used here is the silver halide emulsion described in JP-A-4-166932, JP-A-3-41436, and JP-A-3-41437.

The sensitive material described above is preferably produced by the production control method described in JP-B-4-86817, and production data are preferably recorded therein by the method described in JP-B-6-87146. After or prior to the production data recording, the sensitive material is cut into a width smaller than the conventional 135 size and is then perforated along one side thereof so as to form two perforations for each format frame, which is smaller than the conventional one, according to the method described in JP-A-4-125560.

The film thus obtained is used after being housed in the cartridge package described in JP-A-4-157459, the cartridge example described in the FIG. 9 of JP-A-5-210202, the film patrone described in U.S. Pat. No. 4,221,479, or the cartridge described in U.S. Pat. Nos. 4,834,306, 4,834,366, 5,226,613, or 4,846,418.

From the standpoint of light screening, the film cartridge or film patrone used here is preferably of the type in which the front end of the film can also be completely housed, as described in U.S. Pat. Nos. 4,848,693 and 5,317,355.

Further, a cartridge having a locking mechanism such as the cartridge described in U.S. Pat. No. 5,296,886 is preferred. Also preferred are the cartridge in which the use state of the film is displayed and the cartridge having a function of preventing double exposure as described in U.S. Pat. No. 5,347,334.

It is also possible to use a cartridge into which a film can be easily fitted by merely inserting the film into the cartridge, as described in JP-A-6-85128.

The film cartridge thus fabricated can be used in photographing, processing, and various photographic pleasures according to intended purposes using any of the cameras described below, processors, and laboratory apparatus.

The functions of the film cartridge (patrone) can be fully exhibited when the cartridge is used with, e.g., the easy-loading camera described in JP-A-6-8886 and JP-A-6-99908, the automatic film-winding camera described in JP-A-6-57398 and JP-A-6-101135, the camera in which film exchange is possible during photographing as described in JP-A-6-205690, the camera in which photographing information, e.g., panoramatic photographing, high-definition photographing, or ordinary photographing, can be magnetically recorded on the film (magnetic recording is possible which enables selection of a print aspect ratio) as described in JP-A-5-293138 and JP-A-5-283382, the camera having a function of preventing double exposure as described in JP-A-6-101194, or the camera in which the use state of the film is displayed as described in JP-A-5-150577.

The film thus used in photographing may be processed by the automatic processor described in JP-A-6-222514 and JP-A-6-222545. Prior to, during, or after processing, the method of utilizing the information magnetically recorded on the film as described in JP-A-6-95265 and JP-A-4-123054 may be used, or the function of aspect ratio selection as described in JP-A-5-19364 may be used.

In the case of a motion picture film, the film is spliced by the method described in JP-A-5-119461 before being processed.

During or after processing, the film is subjected to the attaching/detaching treatment described in JP-A-6-148805.

The film thus processed may be subjected to back printing and front printing onto a color print paper to convert the film information into a print, by the method described in JP-A-2-184835, JP-A-4-186335, and JP-A-6-79968.

The processed film may be returned to the customer together with the index print described in JP-A-5-11353 and JP-A-5-232594 and with a return cartridge.

The present invention will be explained below by reference to embodiments thereof.

EXAMPLE 1

Preparation of Emulsion

In 800 cc of distilled water was dissolved 32 g of limed gelatin at 40° C. To this solution were added 5.8 g of sodium chloride and 1.9 cc of N,N'-dimethylimidazolidine-2-thione (1% aqueous solution). This mixture was heated to 44° C., following which a solution of 80 g of silver nitrate in 480 cc of distilled water and a solution of 27.6 g of sodium chloride in 480 cc of distilled water were added thereto with stirring over a period of 60 minutes which maintaining the resulting mixture at 72° C. Subsequently, a solution of 80 g of silver nitrate in 300 cc of distilled water and a solution of 24.3 g of sodium chloride in 300 cc of distilled water were added to the mixture with stirring over a period of 20 minutes while maintaining the resulting mixture at 44° C. This mixture was desalted and washed with water at 40° C., and 90 g of limed gelatin was added thereto. The pAg and pH of the mixture were then adjusted to 7.4 and 6.4, respectively, with sodium chloride and sodium hydroxide. During grain formation, 4 mg of a hexacyanoferrate(II) trihydrate was added. After the reaction mixture was heated to 52° C., fine silver bromide grains were added thereto in such an amount as to result in a 0.6 mol % increase in silver bromide content based on the amount of the emulsion, whereby a silver bromide-rich phase was formed on the surface of the emulsion grains. Thereafter, $1.2\times10^{-5}$ mol of triethylthiourea was added per mol of the silver halide to conduct optimal sulfur sensitization. Further, the blue-sensitive sensitizing dye specified later was added to conduct spectral sensitization. Thus, a silver chlorobromide emulsion having a silver chloride content of 99.4 mol % was obtained, which is referred to as emulsion A.

An emulsion (A') having a desired grain size was prepared in the same manner as for emulsion A, except that the reaction temperature was changed. Further, the same procedures as the above were conducted, except that each of a green-sensitive sensitizing dye and a red-sensitive sensitizing dye was added in place of the blue-sensitive sensitizing dye. Thus, emulsions B and B' and emulsions C and C', each having a silver chloride content of 99.4 mol %, were prepared.

A paper support laminated on both sides with polyethylene was subjected to a surface treatment with corona discharge. A gelatin substratum containing sodium dodecylbenzenesulfonate was formed on the surface-treated support, and various photographic constituent layers were formed thereon to produce a multilayered color photographic paper (101) having the layer constitution described later. The coating fluids used were prepared as follows.

Preparation of Coating Fluid for First Layer

To 23.0 g of magenta coupler (ExM) were added 50.0 cc of ethyl acetate and 40.0 g of solvent (Solv-2) to dissolve the coupler. This solution was added to 500 cc of 20% aqueous gelatin solution containing 8 cc of sodium dodecylbenzenesulfonate, and the resulting mixture was treated with an ultrasonic homogenizer to prepare a dispersion. On the other hand, a silver chlorobromide emulsion was prepared (which was a 1:3 mixture (in terms of Ag molar ratio) of emulsion (A), comprising relatively large cubic grains with an average grain size of 0.49 μm, and emulsion (A'), comprising relatively small cubic grains with an average grain size of 0.40 μm, the large-size emulsion and the small-size emulsion having coefficients of variation of grain size distribution of 0.10 and 0.08, respectively, and each having an AgBr content of 0.6 mol %, the AgBr being selectively present on part of the grain surface). The large-size emulsion and the small-size emulsion contained blue-sensitive sensitizing dye A shown below in amounts of $4.2\times10^{-4}$ mol and $5.3\times10^{-4}$ mol, respectively, per mol of silver.

This blue-sensitive silver chlorobromide emulsion was mixed with the dispersion described above to prepare a coating fluid for first-layer formation which had the composition shown later.

Coating fluids for second- to seventh-layer formation were prepared in the same manner as for the coating fluid for first-layer formation. As a gelatin hardener for each layer was used 1-hydroxy-3,5-dichloro-s-triazine sodium salt.

Further, Cpd-14 and Cpd-15 were added to each layer in amounts of 25.0 mg/m$^2$ and 50.0 mg/m$^2$, respectively.

For the silver chlorobromide emulsion for use in each photosensitive emulsion layer, the following spectral sensitizer dye was used.

Blue-Sensitive Emulsion Layer

Sensitizing dye A

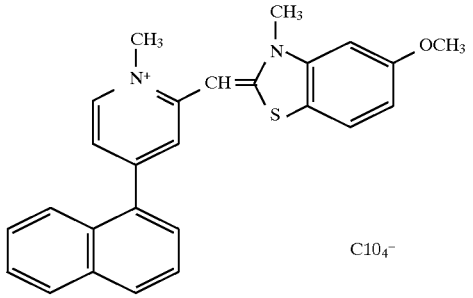

(The dye was added in amounts of $2.0\times10^{-4}$ mol for the large-size emulsion and of $2.5\times10^{-4}$ mol for the small-size emulsion per mol of the silver halide).

Green-Sensitive Emulsion Layer

Sensitizing dye C-α

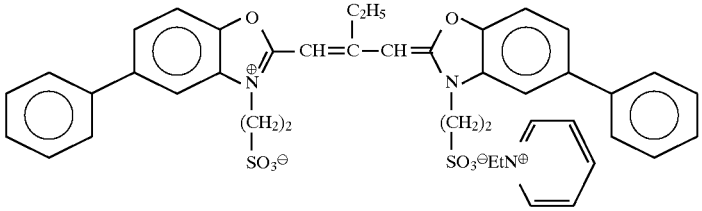

-continued

Sensitizing dye C-β

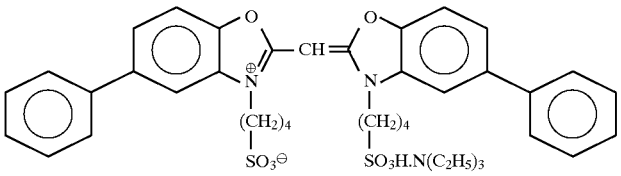

85:15 blend of α and β

(The dye blend was added in amounts of $4.2\times10^{-4}$ mol for the large-size emulsion and of $5.3\times10^{-4}$ mol for the small-size emulsion per mol of the silver halide).

Red-Sensitive Emulsion Layer

Sensitizing dye

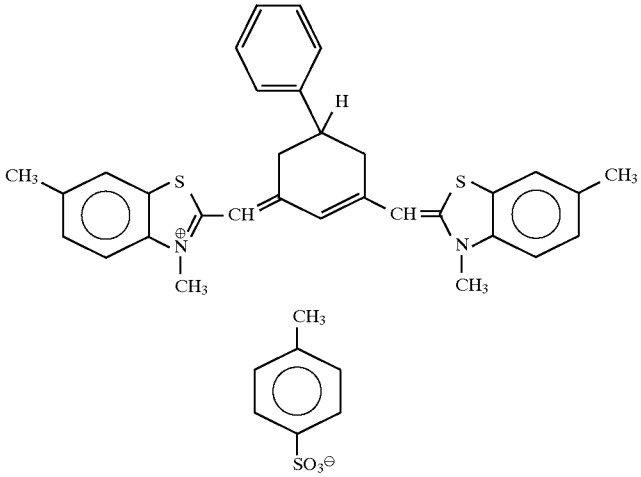

(The dye was added in amounts of $0.9\times10^{-4}$ mol for the large-size emulsion and of $1.1\times10^{-4}$ mol for the small-size emulsion per mol of the silver halide).

The following compound was further added to the red-sensitive emulsion layer in an amount of $2.6\times10^{-3}$ mol per mol of the silver halide.

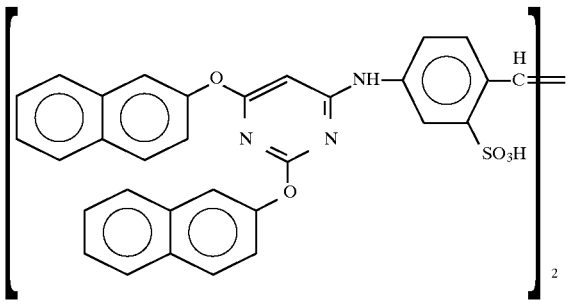

To each of the blue-sensitive emulsion layer, the green-sensitive emulsion layer, and the red-sensitive emulsion layer was also added 1-(5-methylureidophenyl)-5-mercaptotetrazole in amounts of $8.5\times10^{-5}$ mol, $7.7\times10^{-4}$ mol, and $2.5\times10^{-4}$ mol, respectively, per mol of the silver halide.

Further, 4-hydroxy-6-methyl-1,3,3*a*,7-tetrazaindene was added to the blue-sensitive emulsion layer and the green-sensitive emulsion layer in amounts of $1\times10^{-4}$ mol and $2\times10^{-4}$ mol, respectively, per mol of the silver halide.

Furthermore, the following dyes were added (the respective spread rates are shown in the parentheses) to the emulsion layers for anti-irradiation.

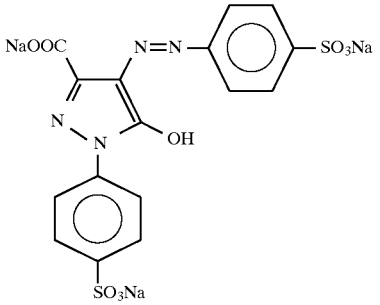

(10mg/m²)

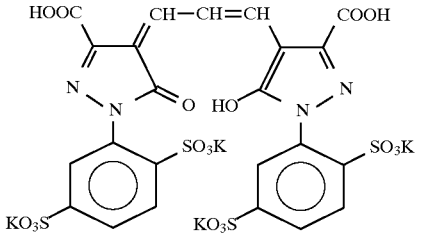

(10mg/m²)

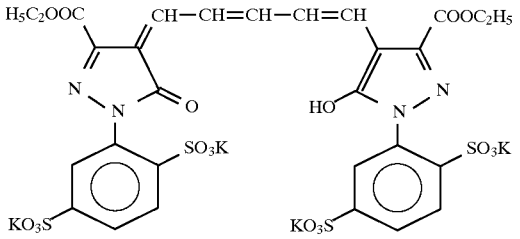

(40mg/m²)

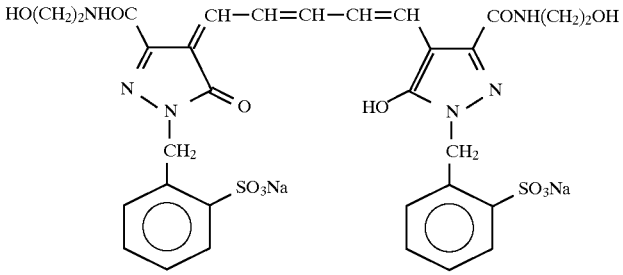

(20mg/m²)

(Layer Constitution)

The composition of each layer is shown below. Each numeral given on the right side indicates the spread rate (g/m²). The spread rate of each silver halide emulsion is given in terms of silver amount.

Support

Polyethylene-laminated paper

[The polyethylene on the first-layer side contained a white pigment ($TiO_2$) and a blue dye (ultramarine).]

First Layer (blue-sensitive emulsion layer)

| | |
|---|---|
| Silver chlorobromide emulsion* | 0.27 |
| Gelatin | 1.36 |
| Yellow coupler (ExY) | 0.79 |
| Dye image stabilizer (Cpd-1) | 0.08 |
| Dye image stabilizer (Cpd-2) | 0.04 |
| Dye image stabilizer (Cpd-3) | 0.08 |
| Solvent (Solv-1) | 0.13 |
| Solvent (Solv-2) | 0.13 |

-continued

*A 3:7 mixture (in terms of silver molar ratio) of emulsion A1, comprising relatively large cubic grains with an average grain size of 0.88 μm, and emulsion A2, comprising relatively small cubic grains with an average grain size of 0.70 μm, the large-size emulsion and the small-size emulsion having coefficients of variation of grain size distribution of 0.08 and 0.10, respectively, and each having a silver bromide content of 0.3 mol %, the silver bromide being selectively present on part of the surface of the grains consisting mainly of silver chloride.

Second Layer (color mixing inhibition layer):

| | |
|---|---|
| Gelatin | 1.00 |
| Color mixing inhibitor (Cpd-4) | 0.06 |
| Solvent (Solv-2) | 0.25 |
| Solvent (Solv-3) | 0.25 |
| Solvent (Solv-7) | 0.03 |

Third Layer (green-sensitive emulsion layer):

| | |
|---|---|
| Silver chlorobromide emulsion | 0.13 |

(A 1:3 mixture (in terms of Ag molar ratio) of emulsion B, comprising relatively large cubic grains with an average grain size of 0.49 μm, and emulsion B', comprising relatively small cubic grains with an average grain size of 0.40 μm, the large-size emulsion and the small-size emulsion having coefficients of variation of grain size distribution of 0.10 and 0.08, respectively, and each having an AgBr content of 0.6 mol %, the AgBr being selectively present on part of the surface of the grains consisting mainly of silver chloride.

-continued

| | |
|---|---|
| Gelatin | 1.45 |
| Magenta coupler (ExM) | 0.16 |
| Dye image stabilizer (Cpd-2) | 0.03 |
| Dye image stabilizer (Cpd-5) | 0.15 |
| Dye image stabilizer (Cpd-6) | 0.01 |
| Dye image stabilizer (Cpd-7) | 0.01 |
| Dye image stabilizer (Cpd-8) | 0.08 |
| Solvent (Solv-3) | 0.50 |
| Solvent (Solv-4) | 0.15 |
| Solvent (Solv-5) | 0.15 |
| Fourth Layer (color mixing inhibition layer): | |
| Gelatin | 0.70 |
| Color mixing inhibitor (Cpd-4) | 0.04 |
| Solvent (Solv-2) | 0.18 |
| Solvent (Solv-3) | 0.18 |
| Solvent (Solv-7) | 0.02 |
| Fifth Layer (red-sensitive emulsion layer): | |
| Silver chlorobromide emulsion | 0.20 |

(A 1:4 mixture (in terms of Ag molar ratio) of emulsion C, comprising relatively large cubic grains with an average grain size of 0.50 μm, and emulsion C', comprising relatively small cubic grains with an average grain size of 0.41 μm, the large-size emulsion and the small-size emulsion having coefficients of variation of grain size distribution of 0.09 and 0.11, respectively, and each having an AgBr content of 0.8 mol %, the AgBr being selectively present on part of the surface of the grains consisting mainly of silver chloride.

-continued

| | |
|---|---|
| Gelatin | 0.85 |
| Cyan coupler (ExC) | 0.33 |
| Ultraviolet absorber (UV-2) | 0.18 |
| Dye image stabilizer (Cpd-1) | 0.33 |
| Dye image stabilizer (Cpd-6) | 0.01 |
| Dye image stabilizer (Cpd-8) | 0.01 |
| Dye image stabilizer (Cpd-9) | 0.01 |
| Dye image stabilizer (Cpd-10) | 0.01 |
| Dye image stabilizer (Cpd-11) | 0.01 |
| Solvent (Solv-1) | 0.01 |
| Solvent (Solv-6) | 0.22 |
| Sixth Layer (ultraviolet absorption layer): | |
| Gelatin | 0.55 |
| Ultraviolet absorber (UV-1) | 0.38 |
| Dye image stabilizer (Cpd-5) | 0.02 |
| Dye image stabilizer (Cpd-12) | 0.15 |
| Seventh Layer (protective layer): | |
| Gelatin | 1.13 |
| Poly(vinyl alcohol) modified by acrylic copolymerization (degree of modification, 17%) | 0.05 |
| Liquid paraffin | 0.02 |
| Surfactant (Cpd-13) | 0.01 |

(ExY) Yellow coupler

1:1 (by mol) mixture of

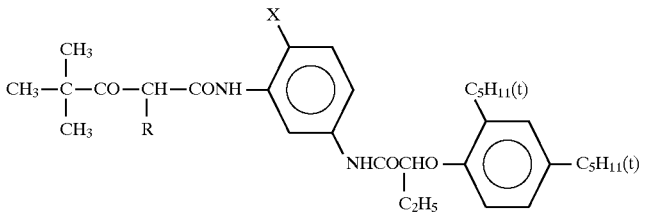

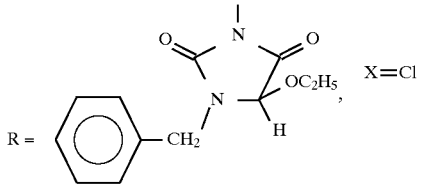

and

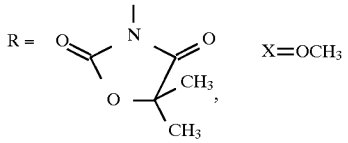

-continued
(ExM) Magenta coupler
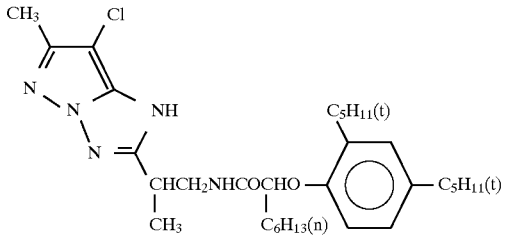
(ExC) Cyan coupler
3:7 (by mol) mixture of
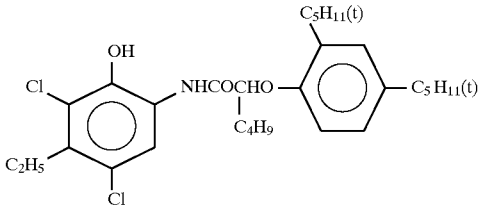
and
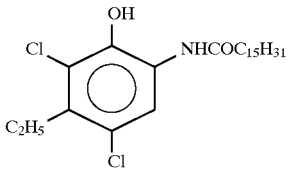
(Cpd-1) Dye image stabilizer
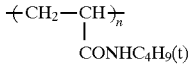
average molecular weight, 60,000
(Cpd-2) Dye image stabilizer
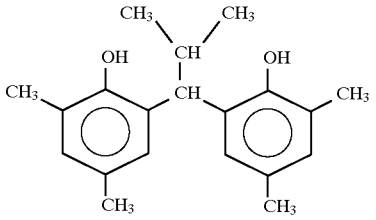
(Cpd-3) Dye image stabilizer
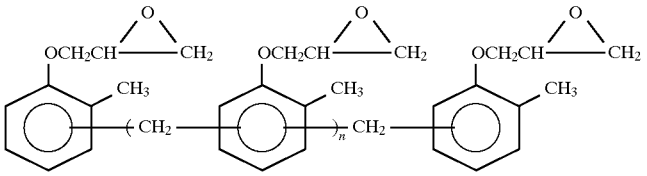
n = 7 to 8 (on average)
(Cpd-4) Dye image stabilizer
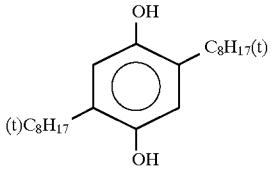

-continued
(Cpd-5) Dye image stabilizer
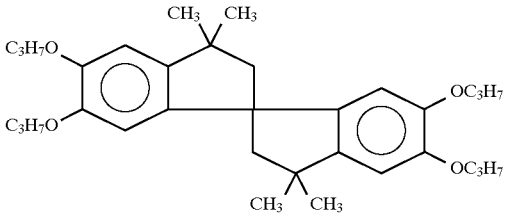
(Cpd-6) Dye image stabilizer
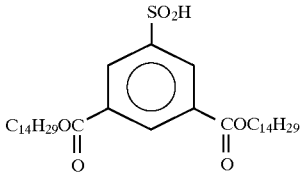
(Cpd-7) Dye image stabilizer
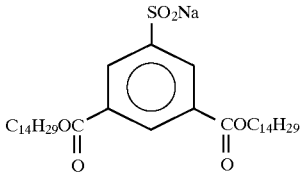
(Cpd-8) Dye image stabilizer
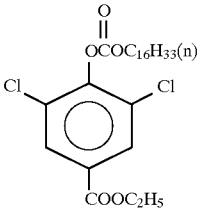
(Cpd-9) Dye image stabilizer
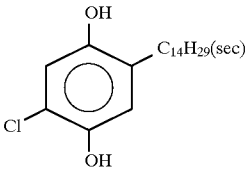
(Cpd-10) Dye image stabilizer
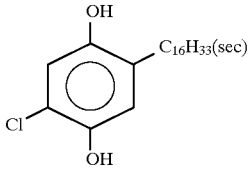
(Cpd-11)
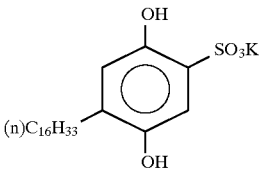

-continued
(Cpd-12)
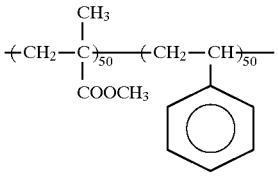
average molecular weight, 60,000
(Cpd-13)
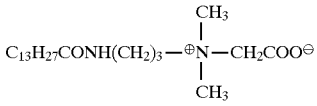
(Cpd-14) Antiseptic
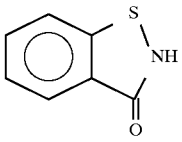
(Cpd-15) Antiseptic
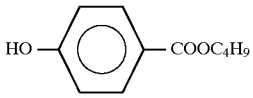
(UV-1) Ultraviolet absorber
1:5:10:5 (by weight) mixture of
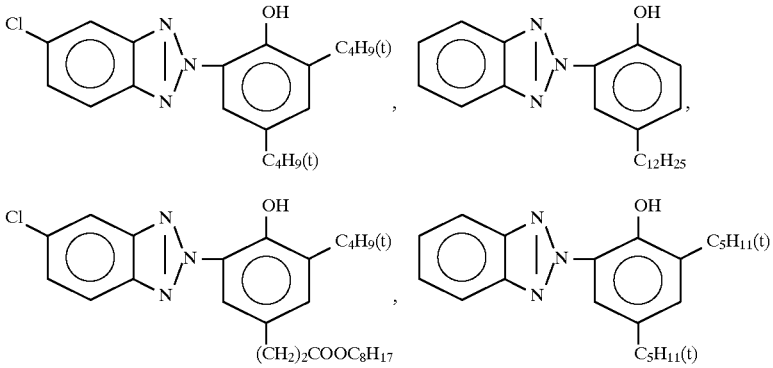
(UV-2) Ultraviolet absorber
1:2:2 (by weight) mixture of
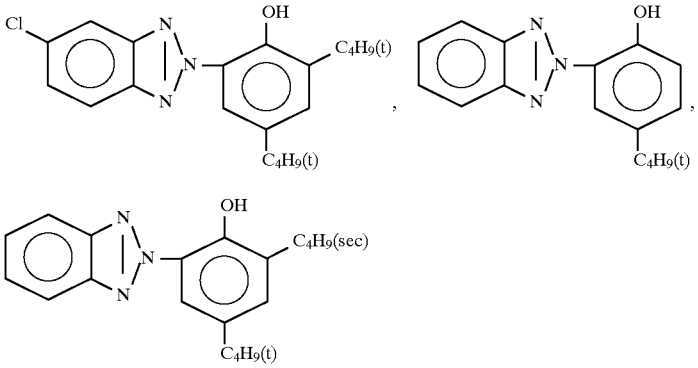
(Solv-1) Solvent
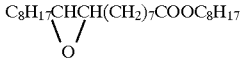

-continued (Solv-2) Solvent

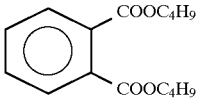

(Solv-3) Solvent

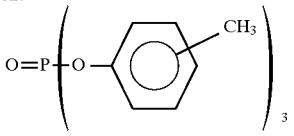

(Solv-4) Solvent

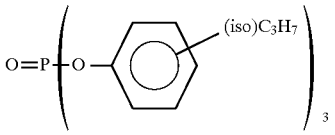

(Solv-5) Solvent

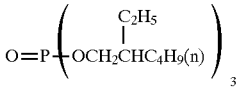

(Solv-6) Solvent

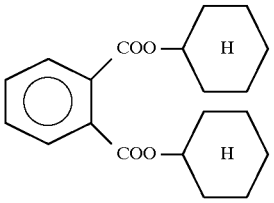

(Solv-7) Solvent

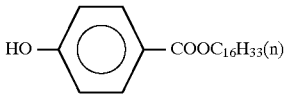

A photographic material sample (102) was produced which had completely the same constitution as the photosensitive material (sample 101) obtained above, except that dye No. 4 according to the present invention was used in place of the sensitizing dye for spectral sensitization in the blue wavelength region.

The addition amount of the dye was the same as that of the dye used in sample 101.

The thus-obtained two kinds of photosensitive materials were examined for a sensitivity change with the lapse of time from coating-fluid preparation, as follows. In one process, the coating fluids for first-layer formation were applied after 20-minutes standing at 40° C. In another process, the coating fluids for first-layer formation were applied after 6-hour standing at 40° C. Each of the samples thus obtained was subjected to $250_{CMS}$ exposure for 1 second through an optical wedge having a blue filter, and then to color development using the processing steps and processing solutions shown below.

In evaluating the sensitivity change with the lapse of time from coating-fluid preparation, $\Delta S$ ($S_A$–$S_B$) was used as a measure of the sensitivity change, in which $S_A$ is the sensitivity of the sample for which the coating fluid for first-layer formation was applied after 20-minute standing at 40° C. and $S_B$ is the sensitivity of the sample for which the coating fluid for first-layer formation was applied after 6-hour standing at 40° C. (The more the value of $\Delta S$ is close to 0, the better the stability of the coating fluid after preparation.)

(Processing)

The samples which had undergone exposure were processed with a paper processor according to the following processing steps, after continuous processing (running) was performed until the replenisher amount reached two times the capacity of the color developing tank.

| Processing step | Temperature | Time | Replenisher* | Tank capacity |
|---|---|---|---|---|
| Color development | 35° C. | 45 sec | 161 ml | 17 liters |
| Bleach-fix | 30–35° C. | 45 sec | 215 ml | 17 liters |
| Rinsing I | 30–35° C. | 20 sec | — | 10 liters |
| Rinsing J | 30–35° C. | 20 sec | — | 10 liters |
| Rinsing K | 30–35° C. | 20 sec | 350 ml | 10 liters |
| Drying | 70–80° C. | 60 sec | | |

The composition of each processing solution was as follows.

| Color Developing Solution: | Tank solution | Replenisher |
|---|---|---|
| Water | 800 ml | 800 ml |
| Ethylenediamine-N,N,N',N'-tetramethylenephosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-Ethyl-N-(α-methanesulfonamidoethyl)- | 5.0 g | 7.0 g |

-continued

| | | |
|---|---|---|
| 3-methyl-4-aminoaniline sulfate | | |
| N,N-Bis(carboxymethyl)hydrazine | 4.0 g | 5.0 g |
| N,N-Di(sulfoethyl)hydroxylamine.1Na | 4.0 g | 5.0 g |
| Brightening agent (WHITEX 4B, manufactured by Sumitomo Chemical Co., Ltd., Japan) | 1.0 g | 2.0 g |
| Water was added to a total volume of | 1000 ml | 1000 ml |
| pH (25° C.) | 10.05 | 10.45 |

Bleach-fix Solution (replenisher was the same as tank solution):

| | |
|---|---|
| Water | 400 ml |
| Ammonium thiosulfate (700 g/l) | 100 ml |
| Sodium sulfite | 17 g |
| Ammonium ethylenediaminetetraacetate(III) | 55 g |
| Disodium ethylenediaminetetraacetate | 5 g |
| Ammonium bromide | 40 g |
| Water was added to a total volume of | 1000 ml |
| pH (25° C.) | 6.0 |

Rinsing Liquid (tank solution and replenisher were the same)

Ion-exchanged water (calcium content, ≦ 3 ppm; magnesium content, ≦ 3 ppm)

*per $m^2$ of the photosensitive material. (Three-tank counter-current rinsing was conducted in which the rinsing liquid flowed from K to I.)

TABLE 1

| Sample | Sensitizing dye for blue-region spectral sensitization | ΔS | Remarks |
|---|---|---|---|
| 101 | sensitizing dye A | 0.08 | comparative |
| 102 | dye No. 4 | 0.02 | present invention |

The effect of the present invention is apparent from Table 1. Namely, Table 1 shows that the sample (101) obtained using a conventional sensitizing dye suffered a considerable desensitization due to the standing of the coating fluid, whereas in the case of the sample obtained using the sensitizing dye according to the present invention, the desensitization caused by the standing of the coating fluid was little.

As demonstrated above, the silver halide photographic material of the present invention is reduced in the sensitivity change caused by the standing of a coating fluid.

While the invention has been described in detail and with reference to specific embodiments thereof, it will be apparent to one skilled in the art that various changes and modifications can be made therein without departing from the spirit and scope thereof.

What is claimed is:

1. A silver halide photographic material which contains a compound represented by formula (II):

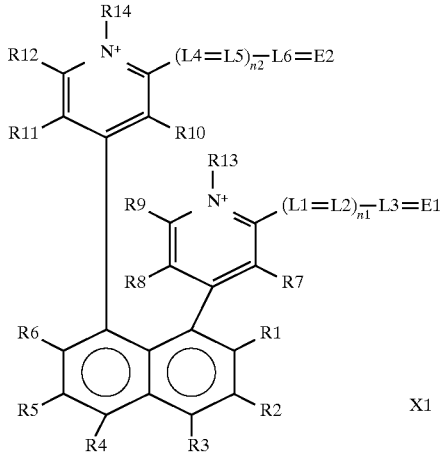

(II)

wherein R1, R2, R3, R4, R5, R6, R7, R8, R9, R10, R11 and R12 each represents a hydrogen atom or a substituent; R13 and R14 each represents an alkyl group; L1, L2, L3, L4, L5 and L6 each represents a methine chain; E1 and E2 each represents an auxochrome; n1 and n2 each is 0, 1, 2, or 3; and X1 represents a counter ion and a light-sensitive silver halide emulsion layer.

2. The silver halide photographic material of claim 1 wherein R1–R12 are each selected from the group consisting of halogen atoms, substituted and unsubstituted alkyl groups having 1–20 carbon atoms, substituted or unsubstituted aryl groups having 1–20 carbon atoms, substituted or unsubstituted alkoxy groups having 1–20 carbon atoms, substituted or unsubstituted aryloxy groups having 1–20 carbon atoms, substituted or unsubstituted acyl groups having 1–20 carbon atoms, substituted or unsubstituted alkylsulfamoyl groups having 1–20 carbon atoms, substituted or unsubstituted alkylcarbonyl groups having 1–20 carbon atoms, substituted or unsubstituted alkylthio groups having 1–20 carbon atoms, substituted or unsubstituted alkenyl groups having 1–20 carbon atoms, substituted or unsubstituted alkynyl groups having 1–20 carbon atoms.

3. The silver halide photographic material of claim 1 wherein the methine chain is substituted with a group selected from the group consisting of alkyl groups, alkoxy groups, amino groups, halogen atoms and aryl groups.

4. The silver halide photographic material of claim 1 wherein E1 and E2 are each selected from the group consisting of 2-pyridyl, 4-pyridyl, 2-quinolyl, 4-quinolyl, 2-thiazolyl, 2-benzothiazolyl, 2-imidazolyl, 2-benzimidazolyl, 2-oxazolyl, 2-benzoxazolyl, 2-quinoxalinyl, 2-indolenyl, 2-rhodanyl, 2-thiohydantoinyl, 2-hydantoinyl, 2-indanyl, 4-dimethylaminophenyl, and 4-hydroxyphenyl.

5. A method of preparing a photographic silver halide emulsion comprising adding a connected-dye compound of formula (II):

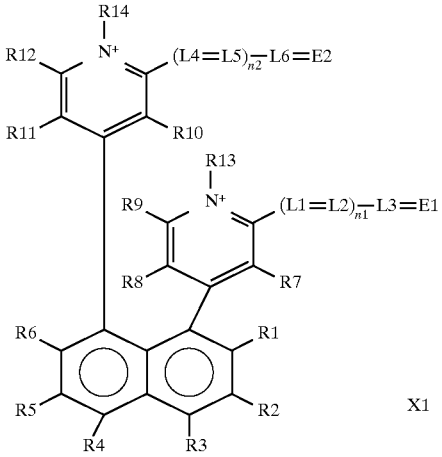

(II)

wherein R1, R2, R3, R4, R5, R6, R7, R8 R9, R10, R11 and R12 each represents a hydrogen atom or a substituent; R13 and R14 each represents an alkyl group; L1, L2, L3, L4, L5 and L6 each represents a methine chain; E1 and E2 each represents an auxochrome; n1 and n2 each is 0, 1, 2, or 3; and X1 represents a counter ion during the preparation of said silver halide emulsion.

6. The method of claim 5 wherein the connected-dye compound is added at $4\times10^{-6}$ to $8\times10^{-3}$ mol per mol of silver halide.

7. A method of preparing a photographic silver halide material comprising adding a connected-dye compound of formula (II):

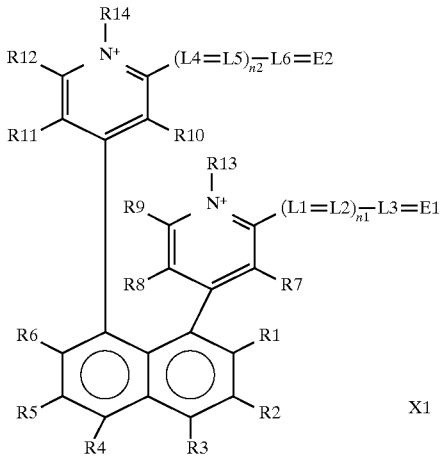

(II)

wherein R1, R2, R3, R4, R5, R6, R7, R8, R9, R10, R11 and R12 each represents a hydrogen atom or a substituent; R13 and R14 each represents an alkyl group; L1, L2, L3, L4, L5 and L6 each represents a methine chain; E1 and E2 each represents an auxochrome: n1 and n2 each is 0, 1, 2, or 3and X1 represents a counter ion to one or more coating fluids for forming a silver halide photographic material layer, a filter layer, or an antihalation layer.

* * * * *